United States Patent [19]

Maa et al.

[11] Patent Number: 5,055,181

[45] Date of Patent: Oct. 8, 1991

[54] HYDROPYROLYSIS-GASIFICATION OF CARBONACEOUS MATERIAL

[75] Inventors: Peter S. Maa, Baton Rouge, La.; Martin L. Gorbaty, Westfield, N.J.

[73] Assignee: Exxon Research and Engineering Company, Florham Park, N.J.

[21] Appl. No.: 284,202

[22] Filed: Dec. 14, 1988

Related U.S. Application Data

[63] Continuation-in-part of Ser. No. 102,885, Sep. 30, 1987, abandoned, which is a continuation-in-part of Ser. No. 844,899, Mar. 27, 1986, abandoned.

[51] Int. Cl.[5] ..... C10G 1/06

[52] U.S. Cl. ..... 208/421; 208/412; 208/413; 208/419; 208/420; 208/422; 208/423; 48/197 R

[58] Field of Search ..... 208/421, 430, 408, 420, 208/412, 413, 423, 419; 48/197 R

[56] References Cited

U.S. PATENT DOCUMENTS

| | | | |
|---|---|---|---|
| 4,003,820 | 1/1977 | Pelofsky et al. | 208/412 |
| 4,012,311 | 3/1977 | Greene | 208/412 |
| 4,048,053 | 9/1977 | Greene | 208/412 |
| 4,097,361 | 6/1978 | Ashworth | 208/430 |
| 4,331,530 | 5/1982 | Qader | 208/430 X |
| 4,379,744 | 4/1983 | Rosenthal et al. | 208/420 |
| 4,417,972 | 11/1983 | Francis et al. | 208/430 X |
| 4,437,974 | 3/1984 | Minami et al. | 208/430 |
| 4,485,003 | 11/1984 | Coenen et al. | 208/420 |
| 4,493,761 | 1/1985 | Hensley, Jr. et al. | 208/421 |
| 4,609,456 | 9/1986 | Deschamps et al. | 208/147 |

FOREIGN PATENT DOCUMENTS

| | | | |
|---|---|---|---|
| 2802998 | 7/1978 | Fed. Rep. of Germany | 208/420 |

*Primary Examiner*—Anthony McFarlane

*Attorney, Agent, or Firm*—Richard E. Nanfeldt; Joseph J. Dvorak

[57] ABSTRACT

Disclosed is a process for obtaining liquids and gases from carbonaceous material, such as coal. The carbonaceous material is first treated with a gasification catalyst, and optionally a hydrogenation catalyst, and hydropyrolyzed for an effective residence time, below the critical temperature at which methane begins to rapidly form, to make liquid products. The resulting char is gasified in the presence of steam at a temperature from about 500° C. to about 900° C.

10 Claims, No Drawings

HYDROPYROLYSIS-GASIFICATION OF CARBONACEOUS MATERIAL

This application is a Continuation-In-Part of U.S. Ser. No. 102,885, filed Sept. 30, 1987, now abandoned, which in turn is a Continuation-In-Part of U.S. Ser. No. 844,899, filed Mar. 27, 1986, now abandoned.

FIELD OF INVENTION

The present invention relates to a process for converting carbonaceous materials, such as coal and heavy petroleum residua, to useful liquids and gases. The process comprises treating the carbonaceous material in the absence of a liquid solvent with a gasification catalyst, subjecting the material to hydropyrolysis, then gasifying the resulting char.

BACKGROUND OF THE INVENTION

Before carbonaceous material is gasified, it generally undergoes pyrolysis which yields liquids, gases, and a solid low H/C material referred to as char. The char can be gasified in the presence of steam to produce CO and $H_2$. If carbonaceous material is used which has a tendency to agglomerate, such as bituminous coals, agglomeration of the carbonaceous material can result during pyrolysis. This is undesirable because of its adverse effects on conventional reactor designs. For example, in fluidized beds, the agglomerated material results in particles too large to fluidize, and in fixed beds, agglomeration can cause the bed to plug.

Attempts to decrease agglomeration include treating the material with basic compounds of alkali and alkaline-earth metals. Furthermore, the treatment of carbonaceous materials, in general, with such compounds enhances the rate of subsequent gasification of char resulting from pyrolysis. While such compounds reduce agglomeration tendency and enhance gasification of the char, they could have a detrimental effect on the production of liquids during pyrolysis. For example, if the pyrolysis is conducted at about atmospheric pressure, relatively low liquid yields result.

Consequently, there is a need in the art for a process for pyrolyzing carbonaceous materials to obtain relatively high liquid yields, followed by gasifying the resulting non-agglomerated char.

SUMMARY OF THE INVENTION

In accordance with the present invention, there is provided a process for obtaining useful liquids and gases from carbonaceous materials, which process consists of:

(a) treating the carbonaceous material in the absence of a liquid solvent with an amount of (i) one or more gasification catalysts selected from the alkali and alkaline-earth metals, and optionally (ii) one or more hydrogention-catalysts selected from the group consisting of oil-soluble and water-soluble salts of a metal selected from Groups VIB, VIIB, and VIII of the Periodic Table of the Elements, wherein the gasification catalysts and/or the hydrogenation catalysts are supported on the carbonaceous material.

(b) contacting the treated carbonaceous material with an effective amount of hydrogen, for an effective residence time, below the critical temperature at which methane begins to rapidly form; and (c) recovering the resulting liquids and hydrocarbon gases, said gases containing methane that is less than 2 wt. % of said carbonaceous material, and (d) gasifying the char resulting from (b) above in the presence of steam at a temperature from about 500° C. to about 900° C., said char being at least 50 wt. % of said carbonaceous material.

In preferred embodiments of the present invention, the carbonaceous material is a material having a tendency to agglomerate, and the hydropyrolysis is performed at a hydrogen treat rate of at least about 5 wt. % hydrogen, based on the weight of carbonaceous material, and at a hydrogen partial pressure of about 300 psig to about 1000 psig.

In other preferred embodiments of the present invention, the carbonaceous material is bituminous coal, the catalyst is potassium or calcium, the hydropyrolysis is conducted in more than one stage, and the gasification is conducted in a separate stage at a temperature from about 600° C. to about 850° C., at pressures from about slightly above atmospheric pressure to about 500 psig.

DETAILED DESCRIPTION OF THE INVENTION

Carbonaceous materials which may be treated in accordance with the present invention include lignites, coals, and heavy petroleum residua. By heavy petroleum residua we mean that fraction of petroleum which is essentially not distillable at a nominal temperature of 500° C. at atmospheric pressure. Coals which may be treated in accordance with the present invention include both subbituminous and bituminous coal. The instant process is particularly beneficial for carbonaceous materials which have a tendency to agglomerate when pyrolyzed, such as bituminous coals.

It is preferred that the carbonaceous material have as high a surface area as possible, although it is not economically justifiable to pulverize solid material to a very fine powder. That is, it is desirable to expose as much of the surface are of the material as possible without losing it as dust and fines, or as the economics of material grinding or process equipment dictate. Generally, the solid material, such as coal, will be crushed and ground to a relatively small size and will contain a majority of particles less than about 4 mesh U.S. Sieve Size.

The as received carbonaceous material is first treated with an aqueous solution containing catalyst constituents having gasification activity. It is also within the scope of this invention to include, in the aqueous solution, catalyst constituents having hydrogenation activity. Such aqueous solutions are prepared from water soluble salts of the particular catalyst species.

Gasification catalysts suitable for use herein are the basic compounds of alkali and alkaline-earth metals, preferably potassium and calcium, more preferably potassium. The aqueous solution containing the gasification catalyst should contain from about 2 to about 30 wt. % water soluble alkali and/or alkaline-earth compounds.

Water soluble hydrogenation catalysts suitable for use herein include compounds containing metals from Groups VIB, VIIB, and VIII, of the Periodic Table for the Elements as illustrated on the last page of *Advanced Inorganic Chemistry*, by Cotton and Wilkinson, 4th Edition, John Wiley, Interscience, 1980. Preferred are compounds containing tungsten, molybdenum, nickel, cobalt, zinc, or iron. Non-limiting examples of such preferred compounds include ammonium heptamolybdate, phosphomolybdic acid, nickel sulfate, cobalt sulfate, and iron acetate. Enough of such compounds are dissolved in water to give a concentration of metal on carbonaceous material of about 100 ppm to about 5000 ppm. Preferred is about 100 ppm to about 1000 ppm.

When coal or lignite are employed in the present invention, they are preferably dried by an appropriate means after treatment with the catalyst-containing aqueous solution, but prior to hydropyrolysis. In the case of the solid carbonaceous material such as coal or lignite the gasification and/or hydrogenation catalyst are supported on the solid carbonaceous material.

When petroleum residua are employed, the catalytic species are preferably introduced by dispersing them in the residua then supporting the residua on a carrier material such as silica, alumina, or petroleum coke.

An alternative method for applying the hydrogenation catalyst is to use a catalyst composition which is soluble in a 400+°C. hydropyrolysis derived oil-fraction. The oil, containing the dissolved catalyst composition, can then be sprayed onto the coal or lignite, or blended directly into the petroleum residua.

It is also within the scope of this invention to first dissolve a water soluble catalyst composition in a small amount of water, then mix the resulting solution with the 400+°C. oil-fraction to form an emulsion. The emulsion can then be sprayed onto the solid carbonaceous material or blended with the heavy petroleum residua.

After treating the carbonaceous material with catalyst, it is subjected to hydropyrolysis in the absence of added hydrogen donor solvent. The hydropyrolysis comprises contacting the carbonaceous material for an effective amount of time, with an effective amount of hydrogen, at a temperature below the critical temperature at which methane begins to rapidly form. By effective amount of time, we mean that range of time required to recover a predetermined amount of liquids, up to the maximum amount achievable by the present invention under the operating conditions and with the reagents employed. Generally, this range of time will be from about 20 to about 90 minutes.

Any suitable pyrolysis reactor design may be used in the hydropyrolysis of the present invention. Non-limiting examples include moving bed and fluidized bed reactors. Preferred are fluidized bed reactors, but if moving bed reactors are used those of a transverse flow design are preferred. The hydropyrolysis may be carried out in one reactor, or two or more reactors may be employed in series, each at increased severity. For example, if two reactors are used in series, the first reactor can be maintained at a temperature from about 360° C. to about 400° C. by a flow of preheated hydrogen. After a sufficient residence time, the carbonaceous material can then be passed from the first reactor to a second, which is maintained at a temperature from about the temperature of the first reactor up to the critical temperature at which methane begins to rapidly form. This critical temperature will generally be below about 500° C., and can be determined by one having ordinary skill in the art by the teaching of the present invention.

The amount of hydrogen which is effective in the hydropyrolysis state of the present invention, will be at least about 5 wt. %, based on the weight of carbonaceous material, and at a partial pressure of about 300 psig to about 1200 psig. Relatively little hydrogen is consumed in the practice of the present invention when compared with more conventional hydropyrolysis processes. For example, as little as 75% even as little as 50% or less, of hydrogen is consumed when compared with such conventional hydropyrolysis processes.

The reason why such small amounts of hydrogen are consumed in the practice of the present invention is because little of it is used to make methane. In conventional hydropyrolysis processes, relatively large amounts of methane are produced, usually from about 10 wt. % to about 30 wt. %, based on the total weight of the carbonaceous feed. The production of methane during hydropyrolysis consumes hydrogen, consequently, it is desirable to keep the production of methane at a minimum so as to keep the consumption of hydrogen at a minimum.

In the process of the instant invention the amount of methane produced is less than about 2 wt. % of the carbonaceous material, more preferably less than 1.5 wt. % and most preferably less than 1.0 wt. %. The instant process produces a char which clearly distinguishes the instant process from a donor solvent process wherein no char is produced. The amount of char produced in the instant process is at least 50 wt. % of the carbonaceous material, more preferably at least 55 wt. % and most preferably at least 60 wt. %.

One novel aspect of the present invention is the discovery of a critical temperature threshold above which methane begins to rapidly form by the reaction of hydrogen with the carbonaceous material. This critical temperature is dependent on such parameters as hydrogen partial pressure, hydrogen flow rate, the rate of heating during hydropyrolysis, the particular carbonaceous material, and the catalyst or catalysts employed.

The present invention may be further understood by reference to the following examples, which are not intended to restrict the scope of the claims appended hereto.

METHOD FOR DETERMINING CRITICAL TEMPERATURE

Although coal and a hydrogen flow of 0.4 SCFM were employed in this example, the example can be followed for any carbonaceous material suitable for use herein and for any appropriate hydrogen treat rate.

The apparatus used in this example was a fixed bed hydropyrolysis unit primarily comprised of a gas manifold, coal hopper, pyrolysis reactor, and fluidized sand bath.

EXAMPLE 1

Rawhide coal (400 g) was charged into the hopper and the reactor was placed into the fluidized sand bath and heated to a temperature of 525° C. at a heating rate of 2.2° C. per minute with preheated hydrogen flowing at a rate of 0.4 SCFM throughout. The coal from the hopper was charged into the reactor when the reactor temperature reached 360° C., with the sand continuing to be heated at a rate of 2.2° C. per minute. The temperature of the reactor dropped dramatically at first because of the introduction of the relatively cold coal, but recovered to the temperature of the sand bath. The temperature of the sand bath and of the reactor were independently recorded and plotted. The temperature at which the temperature in the reactor becomes greater than that of the sand bath is the critical temperature threshold. It is this critical temperature threshold, if exceeded during the hydropyrolysis reaction, which causes rapid formation of methane with increased hydrogen consumption. Consequently, it is essential that the hydropyrolysis stage of the present invention be conducted below this critical temperature threshold.

EXAMPLE 2

The procedure of the above example was followed except that the experiment was stopped at 35 minutes after the coal was charged into the reactor. This corresponded to about 8.2 wt. % hydrogen treat rate based on the weight of coal with the maximum temperature being about 465° C. The yields obtained from the experiments carried out above and below the critical temperature are shown in Table I below.

TABLE 1

| | Higher Temperature Increases Conversion to Gas Not Oil (0.4 SCFM; 7 MPa $H_2$) | |
|---|---|---|
| | (Example 2) | (Example 1) |
| Time Temperature | 372–465° C. 35 min | 371–525° C. 85 min |
| Yields (Wt. % Coal) | | |
| Methane | 1.4 | 11.2 |
| $C_2 + C_3$ | 1.2 | 2.4 |
| Oils | 14.3 | 14.7 |
| Char | 64.5 | 44.6 |
| Hydrogen Consumption (wt. % coal) | 0.6 | 3.7 |

The oil yield showed that it is similar to Example 1 at about 14 wt. % at this milder hydropyrolsis condition. It is evident that the methane made and the hydrogen consumption are much less than in Example 1.

EXAMPLE 3

These comparative experiments show a higher liquid yield obtained with pyrolysis under hydrogen as opposed to pyrolysis under nitrogen, at the same total pressure for potassium catalyzed coal. The experiments were carried out in a 1 lb. capacity fixed bed pyrolysis unit. The catalyzed coal was Illinois #6 treated with a concentrated KOH solution. The catalyzed coal had the following analyses; C=61.11 wt. %, H=4.15 wt. %, Ash=18.03 wt. %, acid soluble K=8.44 wt. % and moisture 1.37% wt. The catalyzed coal was charged into the reactor at 370° C., and heated up to 470° C. (previously determined to be the critical temperature for this coal) in 40 min. The gas flow was set at 0.8 SCFM $H_2$ or $N_2$ and the total pressure was 500 psig. The comparative yields on a dry-ash-free basis are shown in Table 2 below.

TABLE 2

| Yields wt. % DAF Coal | $H_2$ | $N_2$ |
|---|---|---|
| $H_2$ | −2.2 | — |
| $H_2O$ | 8.6 | — |
| CO | | |
| $CO_2$ | 9.4 | — |
| $H_2S$ | 0.6 | — |
| $C_1$ | | |
| $C_2$ | 6.4 | — |
| $C_3$ | | |
| $C_4$+ liquids | 18.7 | 9.7 |
| Char | 58.4 | 68.1 |

It is evident that the oil yield increase was about 9 wt. % with hydropyrolysis compared with nitrogen pyrolysis. The chars obtained from both experiments were free flowing without agglomeration.

Both chars when contacted with steam at a temperature of about 700° C. will be found to gasify at approximately the same rate. This will show that the chars are adequately reactive for gasification.

It is obvious from these data that higher pyrolysis temperature do increase overall conversions, but it is striking that oil yields change very little. Most of the conversion increase is manifested in the methane make. The most significant finding from these data is that hydrogen consumption increases six fold at the higher temperature without adding to the liquid yield. The additional hydrogen appears to be consumed in producing methane.

EXAMPLE 4

Monterey coal and Wyodak coal with and without $K_2CO_3$ and in the presence of a hydrogen donor solvent were subjected to a coal liquefactions process. The comparable data sets as set forth in this example are for Monterey coal and a Wyodak coal with and without 5 wt. % of $K_2CO_3$ added. The experiments were conducted in a 300 cc autoclave reactor at a temperature of 840° C. with a residence time of 40 minutes and in the presence of a multi-pass steady state solvent which contains 1.54 wt. % donatable hydrogen. The hydrogen charge at room temperature was 750 psig and the reaction pressure was about 2000 psig. The solvent to coal react was 1.6 and a 40 gram of coal was used. The comparable yields are illustrated in Table II.

TABLE 3

| | Liquefaction Condition | | | |
|---|---|---|---|---|
| Coal type | Monterey | Monterey | Wyodak | Wyodak |
| Catalyst | none | $K_2CO_3$ | none | $K_2CO_3$ |
| $H_2$ treat, wt. % coal | 1.8 | 1.8 | 1.8 | 2.2 |
| | Yields, wt. % DAF coal | | | |
| Toal $H_2$ consump. | 2.9 | 2.8 | 2.9 | 2.8 |
| $CO_x$ | 2.8 | 3.5 | 7.5 | 8.6 |
| $H_2S$ | 1.2 | 1.3 | 0.1 | 0.2 |
| $H_2O$ | 5.6 | 5.8 | 8.5 | 5.7 |
| $C_1$–$C_3$ | 7.3 | 8.4 | 8.8 | 7.5 |
| $C_4$–1000° F. | 35.3 | 27.2 | 27.0 | 24.2 |
| 1000° F.+ BOTTOMS | 50.7 | 56.5 | 51.1 | 56.6 |
| Delta liquids | base | −8.1 | base | −2.8 |
| Delta conversion | base | −5.8 | base | −5.5 |

The conversion is defined as 100 minus 1000 of+Bottoms. Clearly, the addition of $K_2CO_3$ reduced the conversion for both Monterey and Wyodak coals for about 5–6 wt. % DAF.

What is claimed is:

1. A hydropyrolysis-gasification process for obtaining liquids and gases from carbonaceous material, which process consists of:

(a) treating the carbonaceous material with an amount of (i) one or more gasification catalysts selected from the alkali and alkaline-earth metals, and optionally (ii) one or more hydrogenation-catalyst selected from the group consisting of oil-soluble and water-soluble salts of a metal selected from Groups VIB, VIIB, and VIII of the Periodic Table of the Elements;

(b) contacting the treated carbonaceous material, in the absence of liquid solvent or donor solvent, with an effective amount of hydrogen, for an effective time, below 500° C., and obtaining a mixture of liquids, hydrocarbon gases and char;

(c) recovering the liquids and hydrocarbon gases, wherein said gases contains less than 2 wt. % methane based on the weight of said carbonaceous material; and (d) gasifying the char in the presence of steam at a temperature from about 500° C. to about 900° C., said char being at least 50 wt. % of the carbonaceous material.

2. The process of claim 1 wherein the gasification catalyst is calcium or potassium.

3. The process of claim 2 wherein the carbonaceous material is coal and said gasification catalyst is supported on said coal.

4. The process of claim 3 wherein step (d) of claim 1 is conducted in one or more stages at temperatures from about 600° C. to about 850° C..

5. The process of claim 4 wherein the coal is a bituminous coal and said gasification catalyst is supported on said bituminous coal.

6. The process of claim 5 wherein a Group VIII hydrogenation catalyst is used as well as the gasification catalyst.

7. The process of claim 1 wherein the carbonaceous material is a petroleum residua and is supported on a carrier material.

8. The process of claim 7 wherein the carrier material is selected from the groups consisting of alumina, silica, and coke.

9. The process of claim 8 wherein step (d) of claim 1 is conducted in one or more stages at temperatures from about 600° C. to about 850° C.

10. The process of claim 9 wherein a Group VIII hydrogenation catalyst is also used.

* * * * *